US005170917A

United States Patent [19]

Tourigny

[11] Patent Number: 5,170,917

[45] Date of Patent: Dec. 15, 1992

[54] DISPLAY APPAREL FOR MAPS AND THE LIKE

[76] Inventor: Guy F. Tourigny, P.O. Box 7485, Carmel, Calif. 93921

[21] Appl. No.: 609,502

[22] Filed: Nov. 6, 1990

[51] Int. Cl.[5] ..... A45F 3/14

[52] U.S. Cl. ..... 224/221; 224/219; 224/901; 40/586; 40/904

[58] Field of Search ..... 224/219, 221, 222, 901, 224/267, 191; 150/145; 40/904, 586, 665, 633, 1.5, 644

[56] References Cited

U.S. PATENT DOCUMENTS

| | | | |
|---|---|---|---|
| 3,829,995 | 8/1974 | Fakoury | 40/586 |
| 4,415,106 | 11/1983 | Connell et al. | 224/221 |
| 4,741,372 | 5/1988 | Santilli | 150/145 |
| 4,905,881 | 3/1990 | Graber | 224/901 |

FOREIGN PATENT DOCUMENTS

| | | | |
|---|---|---|---|
| 329795 | 12/1920 | Austria | 224/219 |
| 3242145 | 5/1984 | Fed. Rep. of Germany | 224/222 |
| 1515632 | 1/1968 | France | 40/633 |
| 2209928 | 6/1989 | United Kingdom | 224/222 |

OTHER PUBLICATIONS

Open Air Office TM, Velcro Product News, Nov. 1979 PN No. 62.

*Primary Examiner*—Linda J. Sholl
*Attorney, Agent, or Firm*—Elliot A. Aronson

[57] ABSTRACT

An article to be worn by a user for displaying a map or other document. The display article is formed from a pair of flexible panels joined along three edges and selectively sealable and unsealable by the user along a fourth edge. The panels define a pocket for receiving the map or other document to be displayed. One of the panels provides a transparent window through which the map or document may be viewed. The pocket has a folded and an unfolded configuration and is of a size and dimensions to be worn on the user's arm in unobstructed disposition when in the folded configuration. A pair of armbands is provided for securing the pocket in an observable disposition on the user's arm.

1 Claim, 1 Drawing Sheet

DISPLAY APPAREL FOR MAPS AND THE LIKE

BACKGROUND OF THE INVENTION

The present invention relates to devices for carrying or holding maps or the like.

In a number of activities, such as snow skiing or motorcycle riding, the participant has need for quick and easy reference to materials such as maps or written instructions. A multitude of wallets or pouches are known for carrying such papers or other items such as keys, and though these are very commonly used, they are nevertheless especially inconvenient for persons engaged in physical activities such as skiing, motorcycling or bicycling. Because wallets or pouches are carried in the user's pocket, the user must suspend the activity to remove the wallet or pouch, remove the papers to look at them and then reverse the process. While this may seem like a small and tolerable inconvenience, it nevertheless interferes with many sports and other physical activities since by the nature of the activity the participant's hands may not be free to remove a stored map or other document and hold it while reading. A snow skier, for example, desiring to look at a map of ski trails, has to remove his or her gloves and remove the map from a pocket, which may be inconvenient or difficult in adverse weather conditions or difficult terrain. After reading the map, the skier must then reverse these steps before being ready to continue. After the map is read several times in this manner, it tends to deteriorate through exposure to the elements or mishandling.

In an attempt to alleviate this problem, for skiers at least, map holders are available which attach to a ski pole and which provide a spring-loaded retractable ski map, which is coiled within the map holder and which may be pulled out for reading. Devices of this sort are inconvenient because they require the use of both hands to read the map—one to hold the ski pole and one to extract the map. Moreover, such devices are useful only for skiers and do not help the motorcycle rider or bicyclist. Even for snow skiing this type of device is subject to malfunction from snow, ice and cold temperature.

SUMMARY OF THE INVENTION

The present invention provides a device which makes a map or other document, as well as other necessary items such as keys or money, readily accessible for easy use during physical activity with minimal use of the user's hands, at the same time protecting the document or other item from the elements.

Briefly, a device according to the invention comprises an item of wearing apparel so constructed that it may be worn by the user in an easily observable location such as on the user's arm or forearm. The device includes a pocket for displaying a document, which has a flexible backing panel and a flexible transparent display panel mounted over the backing panel. The two panels taken together define the pocket for carrying the map. The panels are selectively sealable—that is, they may be sealed and unsealed at the selection of the user—for inserting and removing the document. The pocket is structured so that it is foldable on itself such that the transparent display panel is covered and not exposed to the elements when the pocket is in its folded configuration. The device includes a fastener such as a hook and loop fastener for releasably holding the pocket in its folded configuration. The fastener is such as to be easily released or unfastened with one hand so that the user may unfold the pocket and reveal the display panel and displayed document with only a slight movement of a single hand. Secured to the pocket-defining panels is a means, such as an elastic arm band, for securing the pocket to the arm of the user. In this manner, the user carries the document on his or her person in a location where it is readily accessible and may be observed at any time with minimal effort and with minimal interruption of the activity at hand while the user is otherwise occupied.

The display apparel according to the invention is also configured to provide a second convenient pocket for carrying keys, money, or other small objects, to which the wearer may have need for ready access. The second pocket is formed at one panel of the pocket when the main pocket is in its folded configuration. Formed in this manner the second pocket is accessible even though the first pocket remains folded and protected from the environment.

The device of the present invention provides a particularly simple solution to the problem of how to carry necessary reference documents (such as a map) so that they are easily accessible during engaging physical activity. The solution provided by the present invention is economical to manufacture, is compact so that it shows a minimal profile when not unfolded to view the document, and protects the transparent display panel from the elements when the document is not being used.

Other aspects, advantages and features of the invention are described below or will be readily apparent to those skilled in the art from the following specifications and drawings.

DETAILED DESCRIPTION OF A SPECIFIC EMBODIMENT

Figure 1:
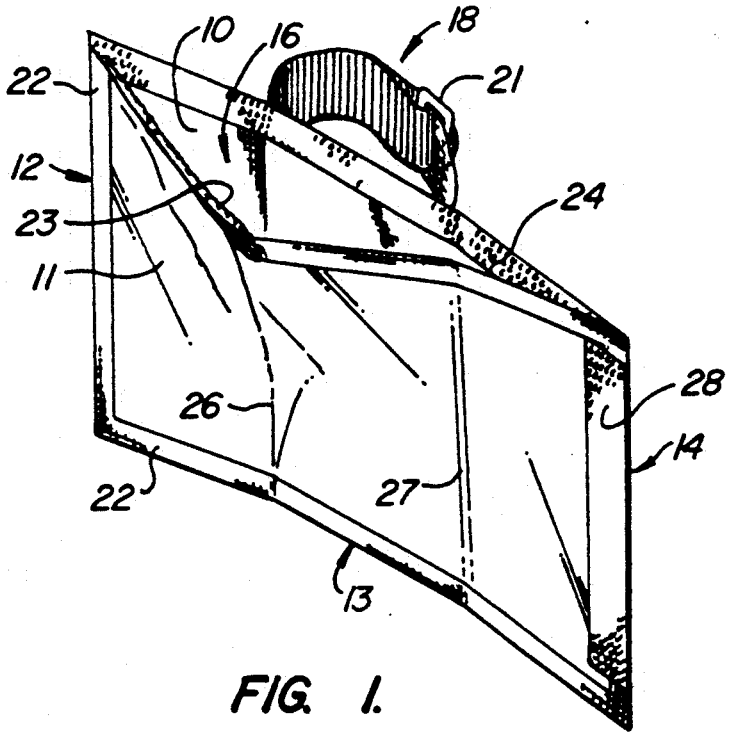
FIG. 1 shows a perspective view of a device according to the invention in its unfolded configuration.

As seen in FIG. 1, a device according to the invention includes a backing panel 10 and a transparent display panel 11, which are secured to one another at three corresponding pairs of edges 12, 13 and 14 to form a pocket, indicated generally at 16. Pocket 16 may be opened and closed by the user along the top edge. Display panel 11 is dimensioned such that the document of interest, such as a portion of a road map or a map of ski trails, is fully visible when inserted in pocket 16. The pocket may, of course, display other types of materials besides maps for which ready access is needed, such as special operating or emergency instructions.

Figure 2:
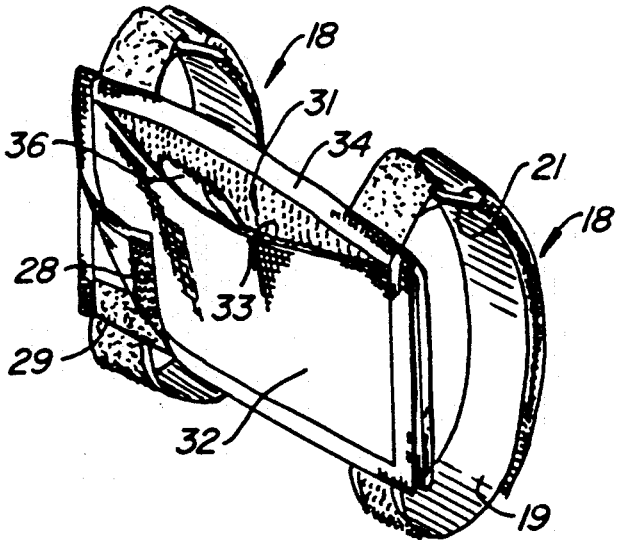
FIG. 2 shows a perspective view of the device in its folded configuration.
Figure 3:
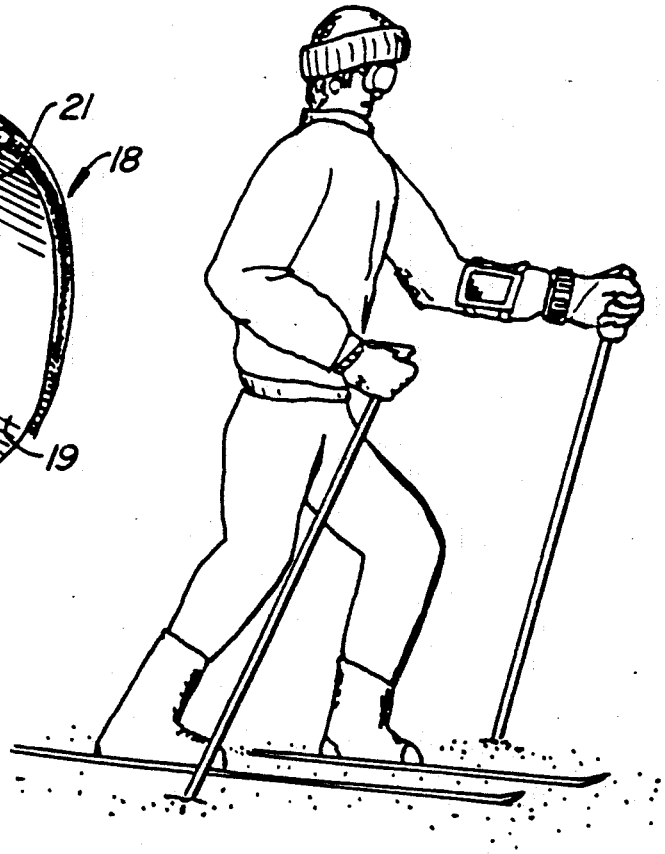
FIG. 3 shows a skier wearing a device according to the invention.

The display device illustrated in FIG. 1 is worn by the user on the forearm or upper arm, as may be convenient. See FIG. 3. To secure the display to the user's arm, the embodiment of FIG. 1 includes two arm bands 18, which are secured to the back of backing panel 10. As illustrated here, arm bands 18 include a strap 19 and buckle 21. Strap 19 is provided with hook and loop fastener VELCRO material so that the strap may be "doubled back" and secured to itself as illustrated in FIG. 2. In this way armbands 18 are continuously adjustable in length. This is an advantageous feature where the apparel is likely to be worn during vigorous activity and it is necessary to secure the apparel firmly to the user's arm, either over bulky clothing or directly to the arm, so that pocket 16 in its unfolded configuration will remain fully visible to the user and will not ride up or down or rotate on the user's arm during the activity. Although shown here as straps of fixed length with an adjustable buckle arrangement, elastic arm bands could also be used with no buckle, or a combination could be used.

Backing panel 10 may conveniently be formed of a water-resistant or waterproof synthetic fabric material such as nylon, and transparent display panel 11 may be formed of readily available clear plastic materials. Persons familiar with the design or manufacturer of wearing apparel for outdoor uses such as skiing will appreciate that the backing panel 10 and display panel 11 can be formed of a variety of materials consistent with the objects of the present invention. The panels may be permanently affixed to one another around the edges 12, 13 and 14 through the use of a bias seaming material 22 in the form of a narrow strip folded around the three edges and sewn into position.

The top edge of pocket 16 is held closed preferably through a hook and loop type of fastener material such as commonly sold under the trade designation Velcro. TM Mounted along the top edge of display panel 11 is a narrow strip 23 of VELCRO hook material, and mounted in an opposing position along the top edge of backing panel 10 is a strip 24 of VELCRO loop material. Although other means may be employed to seal the top edge of the pocket, such as zippers or snap fasteners, the VELCRO hook and loop fastener is generally preferred because it is easy to use and it is less subject to malfunction under the extremes of snow, ice and cold temperature and provides an effective seal against snow, dust and the like.

Nevertheless, in special environments other forms of fasteners, and other panel materials and fabrication techniques, may be desired. For example, for underwater use by divers, the pocket may be constructed to be waterproof at a rated depth. Water-tight materials and fabrication techniques are well known to those skilled in the art and need not be disclosed in any detail here, as their application to the present invention will be recognized, given the benefit of the present disclosure.

To protect display panel 11 and the contents of pocket 16 from unnecessary exposure and to reduce the overall size of the device, pocket 16 is formed to be folded into a closed configuration as illustrated in FIG. 2. For this purpose front and back panels 10 and 11 are formed with two folds 26 and 27 so that the pocket may be folded into thirds. Pocket 16 includes two hook and loop fastener strips 28 and 29 affixed, respectively, to the display side of panel 11 at edge 14 and to the back side of panel 10 at fold 26, which overlie one another when the pocket is folded and serve to keep the pocket in that configuration. The hook and loop fastener is advantageous in that it is easily released by the wearer using one hand. The folded configuration makes for a much more compact unit, which is highly desirable to give the device as small a profile as possible so that it will not interfere with the physical activity of the user. At the same time, the folded configuration enables the user to view a significantly larger portion of the document of interest. Moreover, the folded panels provide protection both for document in pocket 16 as well as for transparent panel 11 so that it will not be scratched.

A second pocket 31 may also be provided on the outwardly facing portion of the first pocket 16 when in its folded configuration. Second pocket 31 is not intended as a display pocket, but rather as a pocket for holding car keys, money or the like so that the contents of the second pocket do not interfere with the display of the contents of the first pocket. Second pocket 31 is formed on one of the faces of backing panel 10 when it is folded. A separate small panel 32 is sewn onto the backing panel 10 around three edges to define the pocket 31. The panel 32 may typically be formed of the same material as backing panel 10. Panel 32 also carries a hook (or loop) fastening strip 33 along one edge, and an opposing loop (or hook) fastening strip 34 is positioned on the backing panel 10 to selectively close second pocket 31. Tab 36 is provided on second pocket 31 to facilitate opening this pocket. A similar tab may also be provided at an edge of the panels 10 and 11 to facilitate unfolding the first pocket.

While the above provides a full disclosure of a preferred embodiment of the invention, various modifications and equivalents will occur to those skilled in the art given the benefit of this disclosure. Accordingly, the invention is not intended to be limited only to the specific examples and embodiment disclosed herein, but is defined by the appended claims.

What is claimed is:

1. An article to be worn by a user for displaying a map or other document comprising:

a flexible fabric backing panel having four edges, said display panel being fixed to said backing panel along three of said edges so as to define a pocket therebetween for receiving said map or other document;

wherein a first hook and loop fastening strip is secured substantially along the entire length of the fourth edge of said display panel and a second hook and loop fastening strip of opposite character is secured substantially along the entire length of said backing panel opposite said first strip for sealing and unsealing said pocket for inserting and removing said map; and wherein said panels are formed with two parallel folds for folding said panels into three overlying portions on the user's arm, said three overlying portions being of a size and dimensions no greater than the width of the user's arm when the three overlying portions are in folded configuration for mounting on the user's arm, such that said folded configuration of overlying portions is generally rectangular in shape;

a third hook and loop fastening strip along a first edge of said transparent display panel substantially perpendicular to said first and second fastening strips;

a fourth hook and loop fastening strip of opposite character to said third strip at a fold of said backing panel disposed so that in said folded configuration said third fastening strip overlies said fourth fastening strip for fastening thereto to maintain said panels in folded configuration; and at least one arm band permanently fixed to said pocket for removably securing said pocket-defining panels to the user's arm;

wherein said arm band comprises a strap having a buckle at one end thereof, said strap being permanently fixed at a midportion thereof to the central portion of said backing panel and not being fixed to the neighboring two portions of said backing panel, said strap being fixed in an orientation generally perpendicular to the longitudinal axis of said generally rectangular shape of said folded configuration such that said longitudinal axis lies along the user's arm when said arm band is secured to the user's arm, and wherein said strap further comprises a fifth hook and loop fastening strip of a hook character on said strap at the tongue end thereof and a sixth hook and loop fastening strip of a loop character no said strap at a midportion thereof disposed so that when said tongue end is passed through said buckle said fifth fastening strip of hook character doubles back to overlie said sixth fastening strip of loop character, whereby said arm band may be securely tightened to hold said pocket-defining panels in fixed disposition with said folded configuration aligned longitudinally along the user's arm during physical activity so as to maintain said pocket in a disposition visible to the user and easily unfoldable without removing from the arm during said physical activity.

* * * * *